US008087417B2

(12) United States Patent
Dobler et al.

(10) Patent No.: US 8,087,417 B2
(45) Date of Patent: Jan. 3, 2012

(54) COSMETIC APPLICATOR

(75) Inventors: Sven Dobler, Huntington, NY (US); Dale Beal, Farmington, NY (US)

(73) Assignee: Orlandi, Inc., Farmingdale, NY (US)

( * ) Notice: Subject to any disclaimer, the term of this patent is extended or adjusted under 35 U.S.C. 154(b) by 47 days.

(21) Appl. No.: 12/800,029

(22) Filed: May 6, 2010

(65) Prior Publication Data

US 2010/0218783 A1 Sep. 2, 2010

Related U.S. Application Data

(63) Continuation of application No. 12/217,377, filed on Jul. 3, 2008, now abandoned.

(51) Int. Cl.
*A45D 40/26* (2006.01)

(52) U.S. Cl. ..... 132/320; 206/581

(58) Field of Classification Search ..... 132/320, 132/319; 206/581, 823, 229; 15/104.93, 15/104.94, 209.1, 210.1; 401/264–266
See application file for complete search history.

(56) References Cited

U.S. PATENT DOCUMENTS

| | | | |
|---|---|---|---|
| 4,611,611 | A | 9/1986 | Beal, Jr. |
| 4,858,631 | A | 8/1989 | Chuang |
| 4,884,719 | A | 12/1989 | Levine et al. |
| 5,137,040 | A | 8/1992 | Iosilevich et al. |
| 6,530,379 | B2 | 3/2003 | Iosilevich |
| 2006/0272671 | A1 | 12/2006 | Dobler et al. |
| 2007/0209133 | A1 | 9/2007 | Linzell |
| 2008/0083423 | A1 | 4/2008 | Dobler et al. |
| 2008/0245381 | A1 | 10/2008 | Iosilevich |
| 2008/0248262 | A1 | 10/2008 | Iosilevich |
| 2008/0295858 | A1 | 12/2008 | Dobler et al. |
| 2009/0053416 | A1 | 2/2009 | Iosilevich |

*Primary Examiner* — Rachel Steitz
(74) *Attorney, Agent, or Firm* — Paul M. Denk

(57) ABSTRACT

The applicator for cosmetics has one or more plies with scoring to form a handle area and a sample area. The scoring upon the top ply guides the applicator to bend into a handle area grasped by a woman's fingers and the sample area has a slight bow to apply eye shadow or other powdered cosmetic as the woman sees fit. The sample area has embossing in the bottom ply to retain pre-deposited cosmetics for further sampling.

2 Claims, 2 Drawing Sheets

COSMETIC APPLICATOR

CROSS REFERENCE TO RELATED APPLICATION

This continuation patent application claims priority to the continuation patent application having Ser. No. 12/217,377, which was filed on Jul. 3, 2008 now abandoned, which claims priority to the non provisional patent application having Ser. No. 11/438,236, which was filed May 22, 2006, which claims priority to the provisional patent application having Ser. No. 60/688,197, which was filed on Jun. 7, 2005.

BACKGROUND OF THE INVENTION

This applicator for cosmetic products relates to sampling devices and more specifically to an improved card for applying cosmetics. A unique aspect of the present applicator is a bowed area of the applicator formed by pinching the applicator.

People have adorned themselves with powders, mascaras, shadows, liners, and other cosmetics for many years. Samples of a cosmetic encourage more sales to discriminating customers. The counter, where the customer may purchase, remains the most effective place to promote cosmetics. Often, retailers and suppliers of cosmetics provide free samples. However, women approach some cosmetic products skeptically, like eye shadow or blush. Women only buy eye shadow after sampling it to see if it suits them. Women also know of the health risks in sampling eye shadow from a common sampler. Multiple uses of a cosmetic sampler invite customer complaints. Sampling an eye shadow or other powdered cosmetic from a common source by more than one person has become socially and medically frowned upon. Many women insist upon sampling from an unopened container of eye shadow or a sample on their hand to avoid medical problems.

To overcome the health risks in cosmetic sampling, the cosmetic industry has made various disposable and other reusable applicators and other cosmetic dispensers. The applicators remain subject to contamination at the retail counter. Further, cosmetic suppliers still incur the cost of producing and distributing the applicators for each color or product line variation. In addition, cosmetic suppliers and retailers have tried cotton swabs that dab from a common cosmetic source, sample sticks, and test strips. These alternatives when used commercially caused messes, inconvenienced customers, and proved ineffective.

Beyond current test samplers, the cosmetic industry seeks an inexpensive applicator for applying a cosmetic sample to skin in a single stroke. Presently, cosmetics such as eye shadow have individual applicators that indirectly place powders or eye shadow upon the face of a woman. When applied, the eye shadow sample should have the same texture, feel, and characteristics regardless of the applicator. Because of the goal for similarity between a sample and the eye shadow for sale, applicators usually are miniature conventional applicators or brushes despite other possibilities.

The present art overcomes the limitations of the prior art. That is, in the art of the present invention, an applicator for cosmetics is prepared with a powdered eye shadow or other cosmetic that allows each woman to sample the cosmetic individually.

The difficulty in providing an applicator for cosmetics is shown by the operation of a typical product sample at a cosmetics counter, or department store.

Embossing in prior art patents, serving as stilting, protects a cosmetic material, or eye, between the base ply and the top cover ply. The present invention merely serves as an applicator readily grasped. The present invention allows a woman to grasp an applicator with two fingers and apply a sample as she sees fit. The present invention reduces the need for brushes and separate applicators. As the woman samples the eye shadow promptly after opening the present invention, stability and compatibility concerns of the eye shadow do not arise.

The present invention overcomes the difficulties of the prior art. The cosmetic applicator has a single ply for ease of manufacturing and alternatively, multiple plies. At a display counter, the present invention is easier to use and has less shipping, manufacturing, and storage costs. Combined with eye shadow and other powdered sampling components presently at cosmetics' counters, the applicator for cosmetics readily integrate into existing sampling programs.

SUMMARY OF THE INVENTION

The applicator for cosmetics is a two ply card with scoring to form an easily handled applicator. The scoring upon the bottom ply guides the applicator to bend into a handle area and a sample area. The handle area is grasped by a woman's fingers and the sample area has a slight bow to apply eye shadow or other powdered cosmetic as the woman sees fit. Also, the sample area has embossing in the bottom ply to retain pre-deposited cosmetic for later sampling.

At a counter, a woman surveys the samples of eye shadows and powders and selects a few of her choosing. The woman takes the present invention and grasps the handle area opposite the sample area. The scoring folds the handle area to fit within two fingers and bows the sample area outward. After grasping the handle area, a woman applies the sample to her face as desired by swiping the sample area against her skin. Following use, a woman lets go of the present invention and disposes it.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and devices for carrying out the several purposes of the present invention. It is important, therefore, that the claims be regarded as including such equivalent constructions insofar as they do not depart from the spirit and the scope of the present invention.

Therefore, it is an object of the invention to provide a cosmetic applicator, for eye shadow, blush, and other cosmetic ingredients such as foundation.

It is a further object of the present invention to provide an applicator for holding by one hand.

It is a still further object of the present invention to provide an applicator that bows outward to ease application of a cosmetic sample.

These and other objects may become more apparent to those skilled in the art upon review of the invention as described herein, and upon undertaking a study of the description of its preferred embodiment, when viewed in conjunction with the drawings.

BRIEF DESCRIPTION OF THE DRAWINGS

The same reference numerals refer to the same parts throughout the various figures.

DESCRIPTION OF THE PREFERRED EMBODIMENT

Figure 1:
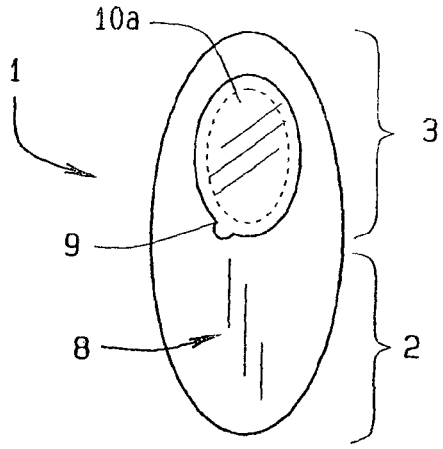
FIG. 1 shows a plan view of the preferred embodiment of the applicator for cosmetic products in the shape of an oval and constructed in accordance with the principles of the present invention.
Figure 2A:
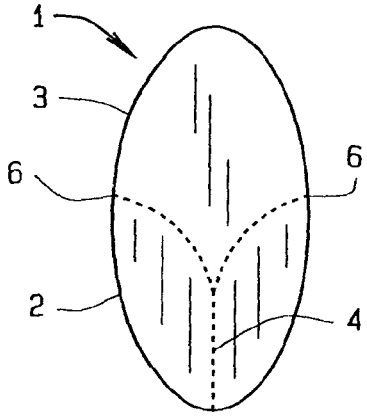
FIG. 2A shows a plan view of scoring forming a line along a portion of the longitudinal axis of the present invention denoting the handle area and a pointed oval denoting the sample area.

The present art overcomes the prior art by providing a cosmetic applicator, generally in an oval shape, easily grasped by two fingers that applies a cosmetic as desired by the customer. Turning to FIG. 1, the preferred embodiment of the applicator 1 begins as an oval of two ply material. FIG. 1 shows a smooth finish bottom ply. FIG. 2A then begins to show the scoring 4, 5, 6, 7 that forms the present invention 1. The bottom ply has scoring on a center line 4 from an edge along the longitudinal axis of the bottom ply. The center line 4 scoring extends upwards of one half of the length of the present invention. From the end of the center line 4 opposite the edge, scoring 6 for curves extends symmetrically outwards in a convex 6 manner leaving a pointed oval area. This scoring 6 has a radius of curvature that bends the bottom ply into a handle area 2 suitable for grasping by a person's thumb and forefinger. Opposite the handle area 2, the curves scoring 6 leaves at least one third of the present invention available for deposition of a cosmetic sample 10*a*. The curves scoring 6 defines the sample area 3 of the present invention 1. In an alternate embodiment, the applicator 1 is round. In a further alternate embodiment, the applicator 1 is rectangular. And in a still further alternate embodiment, the applicator 1 is square in shape.

Figure 2B:
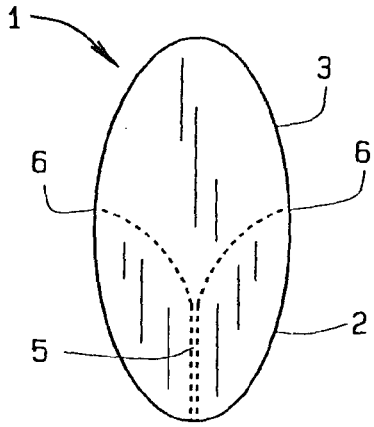
FIG. 2B shows a plan view of scoring forming a channel of two lines along a portion of the longitudinal axis of the present invention denoting the handle area and a pointed oval denoting the sample area.

FIG. 2B then shows alternate scoring for the present invention. The bottom ply has scoring on two lines 5 from an edge along the longitudinal axis of the bottom ply. The two lines form a channel 5 that extends upwards of one half of the length of the present invention. From the end of the channel 5 opposite the edge, scoring 6 for curves extends symmetrically outwards in a convex 6 manner, leaving a pointed oval area. As before, the scoring 6 has a radius of curvature that bends and forms a handle area 2 suitable for grasping by a thumb and forefinger. Opposite the handle area 2, the curves scoring 6 leaves the sample area 3 of the present invention 1.

Figure 3A:
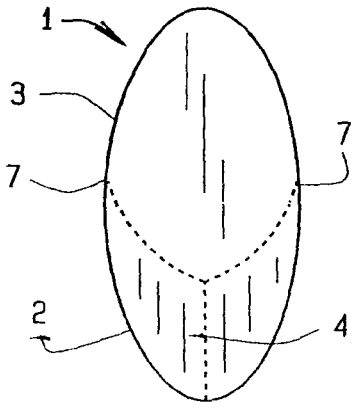
FIG. 3A shows a plan view of scoring forming a line along a portion of the longitudinal axis of the present invention denoting the handle area and an oval denoting the sample area.

A second alternate scoring appears in FIG. 3A of the present invention. The bottom ply has scoring on a center line 4 from an edge along the longitudinal axis that extends upwards of one half of the length of the present invention. From the end of the center line 4 opposite the edge, scoring 7 for curves extends symmetrically outwards in a concave 7 manner, leaving an oval shaped area 3. This scoring 7 has a radius of curvature that bends the bottom ply into a handle area 2 suitable for grasping by a thumb and forefinger. Opposite the handle area 2, the curves scoring 7 leaves at least one third of the present invention 1 available for deposition of a sample. The curves scoring 7 defines the sample area 3 of the present invention 1 as before.

Figure 3B:
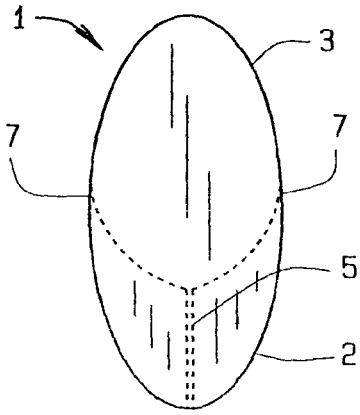
FIG. 3B shows a plan view of scoring forming a channel of two lines along a portion of the longitudinal axis of the present invention denoting the handle area and an oval denoting the sample area.

FIG. 3B then shows alternate scoring for the present invention 1. The bottom ply has scoring on two lines 5 from an edge along the longitudinal axis of the bottom ply. The two lines form a channel 5 that extends upwards of one half of the length of the present invention. From the end of the channel 5 opposite the edge, scoring 7 for curves extends symmetrically outwards in a concave 7 manner, resulting in an oval shaped area. As before, this scoring 7 has a radius of curvature that bends and forms a handle area 2 suitable for grasping by a person's thumb and forefinger. Opposite the handle area 2, the curves scoring 7 leaves the sample area 3 of the present invention 1.

Figure 4A:
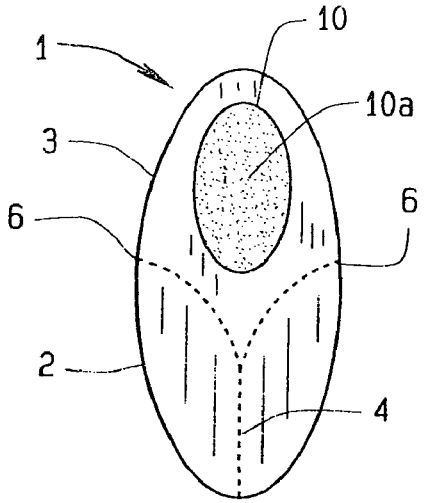
FIG. 4A shows a plan view of scoring forming a line denoting the handle area and a sample upon the pointed oval denoting the sample area.
Figure 4B:
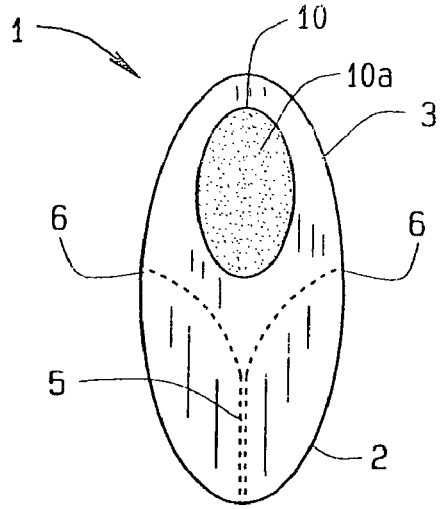
FIG. 4B shows a plan view of scoring forming a channel of two lines denoting the handle area and a sample upon the pointed oval denoting the sample area.
Figure 5A:
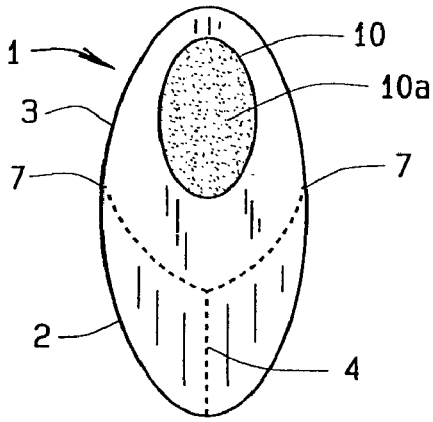
FIG. 5A shows a plan view of scoring forming a line denoting the handle area and a sample upon an oval denoting the sample area.
Figure 5B:
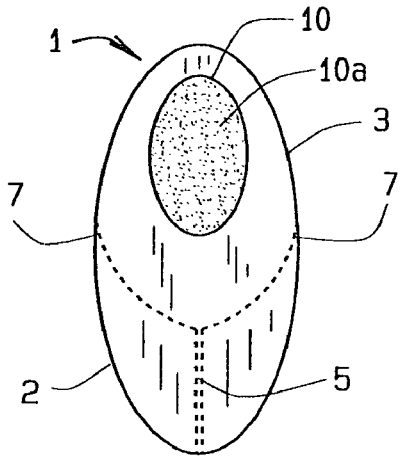
FIG. 5B shows a plan view of scoring forming a channel of two lines denoting the handle area and a sample an oval denoting the sample area; and, FIG. 6 describes a plan view of an alternate embodiment of the sample area upon the present invention.
Figure 6:
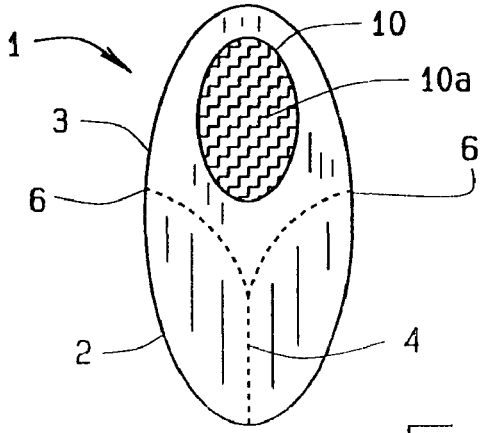

FIGS. 4A and 4B show a sample of cosmetic applied in the sample area 3 having a pointed shape while FIGS. 5A and 5B have the cosmetic sample applied in the oval shaped sample area 3. The cosmetic sample can be eye shadow, blush, foundation, crème, or lipstick among other things. The cosmetic sample rests upon the bottom ply 8 and then a removable top ply 9 covers the cosmetic sample. The top ply 9 is generally transparent to show the color of the cosmetic sample beneath. Regarding the bottom ply 8 though, an embossed pattern 10 rises from the bottom ply. The pattern 10 has the appearance of an oval shape surrounded by a smooth field. In the preferred embodiment, the pattern 10 has a plurality of raised dots in a grid, shaped as an oval. The dots occupy approximately 5% to 50% of the surface area of the bottom ply. In an alternate embodiment shown in FIG. 6, the pattern 10 has a series of parallel lines generally diagonal in reference to the longitudinal axis. The pattern 10 rises from the bottom ply somewhat less than three thicknesses of the bottom ply, approximately 3 mils in height.

While the sample area may be flat and untreated, many methods can form the sample area 3 and pattern 10 such as mechanically embossed printing or deposition. A mechanical embosser uses a roller or flat tool with a positive image of the pattern. The card passes under a roller or flat embossing tool which impresses the pattern upon the material of the applicator 1. After a mechanical pattern is formed into the applicator 1, a precisely measured amount of cosmetic is placed and spread upon the sample area 3.

Printing forms a sample area 3 by its own methods. In general, printing places a pattern of greater height than the applicator 1 upon its surface. Printing includes the methods of silkscreen, offset, lithography, rotogravure, flexography, thermography and ultraviolet printing that use ink. The inks adhere to the surface of the applicator 1 and the cosmetic sample collects between portions of the ink.

Deposition involves creating a deposit area, or pattern, by methods of thermoforming, vacuum forming, casting, heat treatment, electrostatic treatment, spraying, extruding, adhesives, and cohesives. After a pattern is deposited on the applicator 1, cosmetic material is placed in the sample area 3 having this pattern. The pattern retains the cosmetic until the applicator 1 is used.

In use, a woman utilizes the shaped applicator 1, preferably oval shaped, to transfer a sample of cosmetics, or eye shadow, to her face for viewing and shopping. A woman folds the applicator 1 along the center scoring 4, 5 with the halves folding away from the woman along the curves scoring 6, 7. Away from the handle area 2, the embossed pattern 10 in the sample area 3 is ready to transfer a cosmetic once in contact with a woman's face. A woman holds the handle area 2 using two fingers and places the sample area 3 at a desired location. The woman then gently strokes the sample area 3 upon the desired location to transfer the cosmetic to her body. The woman can then view and inspect the cosmetic for a purchase decision.

From the aforementioned description, an applicator for cosmetic products has been described. The applicator for cosmetic products and its various components may be manufactured from many materials, including but not limited to singly or in combination, paper, polymers, polyester, polyethylene, polypropylene, polyvinyl chloride, nylon, Teslin, Saran, open cell foam, closed cell foam, ferrous and nonferrous metal foils and their alloys, and composites.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A cosmetic applicator for applying beauty product upon the body of a consumer, comprising;

an applicator, having a longitudinal axis, a length, at least two side edges outwardly from said longitudinal axis, a handle area and a sample area contiguous and integrally formed with said handle area;

a cosmetic located in said sample area;

said handle area having two parallel scoring lines partially along the longitudinal axis of said applicator, said parallel scoring lines extending for approximately half of the length of said applicator;

said handle area also having two symmetric score lines extending from said parallel scoring lines in one of a concave or a convex manner and terminating proximate the side edges of the applicator approximately at its midpoint, said score lines adapted to partially fold said handle away from said sample area thus aiding the grip of a consumer upon said applicator;

said applicator being formed as a flat planar shape having a bottom ply and a transparent top ply, said bottom ply forming the handle area and the sample area, said sample area having a plurality of raised dots over approximately 5% to approximately 50% of said bottom ply, and said top ply covering said sample area until removed by a consumer as said cosmetic remains visible;

said cosmetic is applied in said sample area by one of mechanically embossed printing or deposition, said cosmetic including at least an eye shadow, blush, foundation make-up, crèmes, or lipstick; and, said cosmetic being placed onto said applicator at the sample area, said cosmetic being applied by one of silkscreening, flexography, extrusion, rotogravure, or electrostatic image, and said applicator having a shape of one of oval, round, rectangular, or square, whereby the consumer upon peeling the top ply from the sample area, and upon pinching the handle area at the vicinity of its scoring, can hold the applicator in one hand while applying the cosmetic upon the desired location of the body.

2. The applicator of claim 1 wherein said deposition creates a deposit area by one of thermoforming, vacuum forming, casting, heat treatment, electrostatic treatment, extruding, adhesives, cohesives, or photopolymer chemistry.

* * * * *